United States Patent [19]

Pajevic

[11] Patent Number: 4,924,859

[45] Date of Patent: May 15, 1990

[54] PLANAR BODY STIMULATING ASSEMBLY

[76] Inventor: Paul D. Pajevic, 1461A W. Lunt Ave., Elk Grove Village, Ill. 60007

[21] Appl. No.: 239,648

[22] Filed: Sep. 2, 1988

[51] Int. Cl.[5] ..... A61H 7/00

[52] U.S. Cl. ..... 128/52; 128/44

[58] Field of Search ..... 128/51, 52, 58, 56, 128/57, 44

[56] References Cited

U.S. PATENT DOCUMENTS

| | | | |
|---|---|---|---|
| 1,265,074 | 5/1918 | Gardner | 128/58 |
| 2,004,428 | 6/1935 | Davies | 128/51 |
| 2,543,493 | 2/1951 | Gaudette et al. | 128/58 |
| 2,577,646 | 12/1951 | Cameron | 128/58 |
| 3,636,946 | 1/1972 | Hardy | 128/57 |
| 3,876,200 | 4/1975 | Bush et al. | 128/57 |
| 4,154,232 | 5/1979 | Fukazawa | 128/58 |

*Primary Examiner*—Edgar S. Burr
*Assistant Examiner*—Huong Q. Pham

[57] ABSTRACT

A planar body stimulating assembly that includes a plurality of rows of spheroidal silicon rubber members connected by a single cable having ends alternately pulled by a single reciprocating shock absorbing tension assembly.

9 Claims, 2 Drawing Sheets

PLANAR BODY STIMULATING ASSEMBLY

BACKGROUND OF THE INVENTION

Body stimulating and circulation improving cushions and mattresses have been known for many decades and some have found significant commercial success, but at the same time most have not been commercially successful because of their mechanical complexities and weight, rendering them difficult to install, and high cost. Most mechanical stimulators employ some vibration techniques. For example, some waterbed-type mattresses have mechanical agitators for the liquid, and they create a medium frequency shock wave through the liquid. Still other mechanical vibration-producing assemblies include levers, cams and reciprocating rods, and these have the disadvantages not only of mechanical complexity and cost, but that the mechanical components themselves, because of their rigid construction, result in a diminution in flexibility of the cushions that detracts from the comfort and therapeutic effect.

It is a primary objection of the present invention to ameliorate the problems noted above in vibratory mechanisms for cushions and mattresses.

SUMMARY OF THE PRESENT INVENTION

In accordance with the present invention, a planar body stimulating assembly is provided that creates low frequency reciprocation of a plurality of rows of spheroidal silicon rubber members and is simple in construction while maintaining the utmost flexibility to assure user comfort and therapeutic effect.

Toward these ends, the spheroidal members have a low durometer in the range of 30 to 60 Shore A, and they are interconnected by a single insert-molded nylon cable carried by a plurality of idler pulleys at the ends of the rows with the ends of the cable being alternately pulled by a reciprocating tension assembly with shock-absorbing connections to the cable.

The reciprocating rod is driven with an axially fixed worm gear in turn driven by a surrounding interengaging worm wheel reversely rotated by a separately mounted reversing motor that has a periodically reversing output shaft connected to the worm wheel through a flexible cable.

An important aspect of the present invention is that reciprocation of the cable and, hence, the spheroidal rubber members occurs at a low frequency of approximately 60 cycles per second, and the extent of linear reciprocation of the rubber members is approximately ½ inch. This provides increased body tissue stimulation and improved vascular perfusion over prior known therapeutic vibrating devices.

Because of the cable's flexibility and the complete absence of any rigid mechanical components between the ends of the rows of silicon rubber members, the present stimulating assembly is flexible in all directions between the ends of the rows assuring improved user comfort. Moreover, this flexibility between the ends of the rows permits the entire assembly to be rolled for packing and shipping when utilized as an adjunct cushion for placement either over a mattress or an existing chair cushion.

It should be understood that the present body stimulating assembly can either be built into and part of a bed mattress, or built into a chair cushion during its original manufacture, or alternatively, may be made as a separate assembly from the mattress or seat cushion, in which case it could be considerably less thick, and utilized as an after-market item to be placed over the mattress or seat cushion.

Other objects and advantages of the present invention will appear hereinafter.

DETAILED DESCRIPTION OF THE PREFERRED EMBODIMENT

Figures 1, 3, 4, 5:
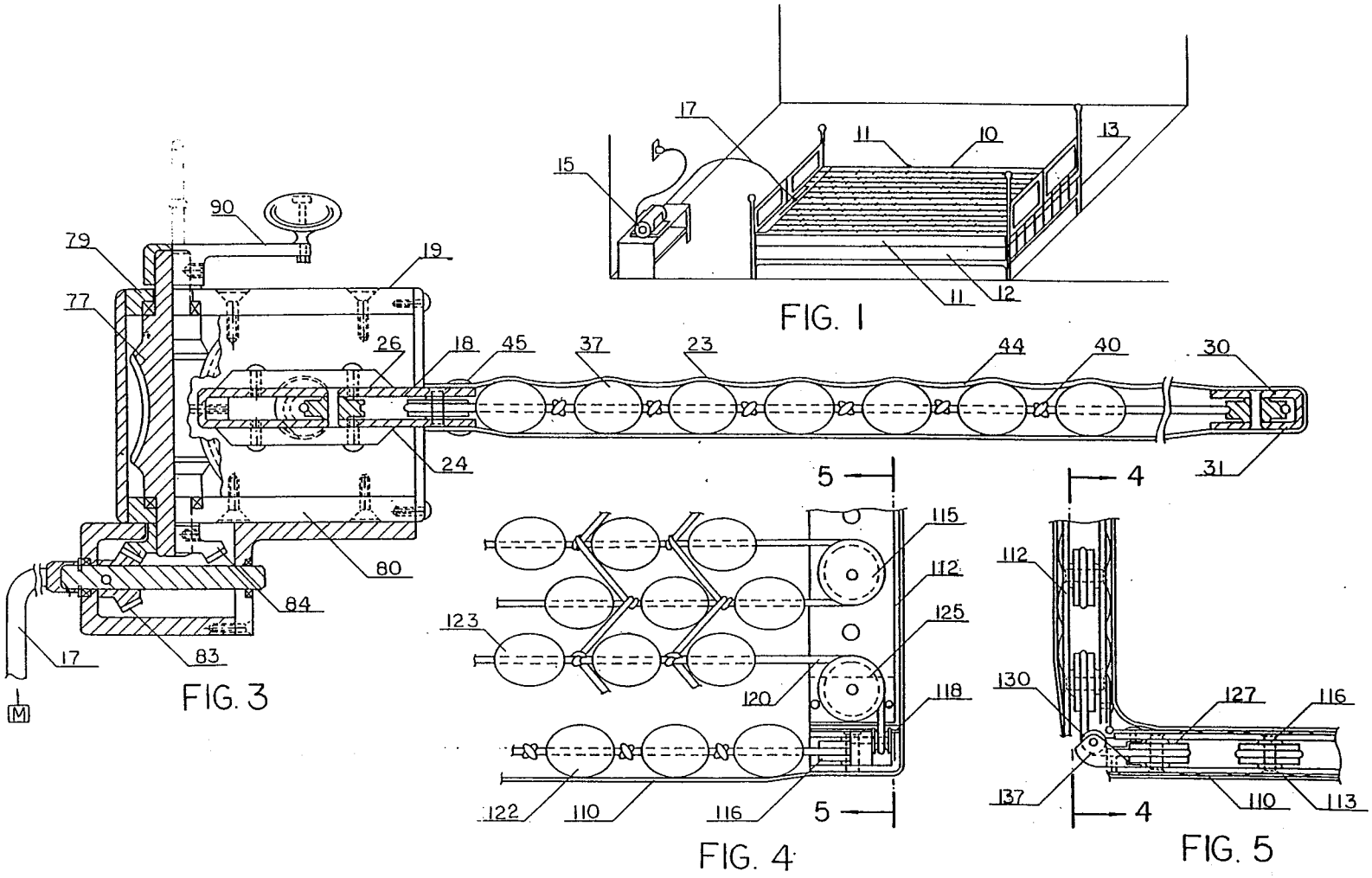
FIG. 1 is a perspective view of a conventional bed spring arrangement illustrating the present body stimulating assembly in position.
FIG. 3 is a transverse longitudinal section of the present body stimulating assembly taken generally along line 3—3 of FIG. 2.
FIG. 4 is a fragmentary section of another embodiment of the present body stimulating assembly taken generally along line 4—4 of FIG. 5.
FIG. 5 is a fragmentary section of the body stimulating assembly illustrated in FIG. 4 taken generally along line 5—5 of FIG. 4.

Referring to the drawings and particularly FIG. 1, the present body stimulating assembly 10 is seen in place on top of a conventional mattress 11 and box spring 12 mounted on a standard bed frame 13. Body stimulating assembly 10 includes a flexible planar cushion assembly 11 and an automatically reversing drive motor 15 connected to drive the cushion assembly 11 through a flexible cable 17.

Figure 2:
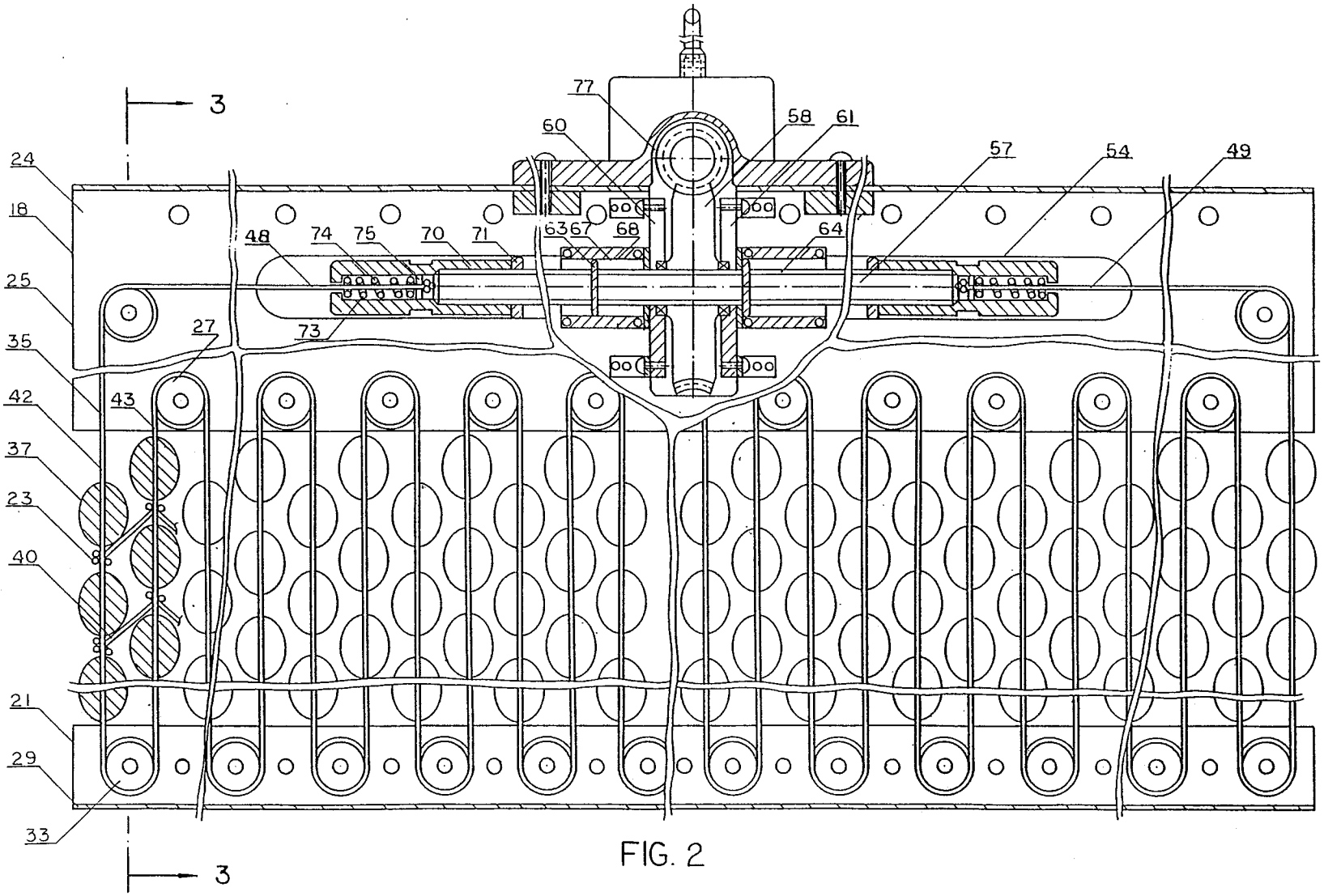
FIG. 2 is an enlarged longitudinal section of the body stimulating assembly illustrated in FIG. 1.

As seen more clearly in FIGS. 2 and 3, the low frequency vibratory cushion assembly 11 is seen to include a top drive and frame assembly 18 with a gear box assembly 19 carried thereby, a bottom frame assembly 21, and an intermediate cushion section 23 interconnecting the frame assemblies 18 and 21.

The top frame assembly 18 includes a U-shaped frame member 25 having an upper wall 26 and a lower wall 24 between which are rotatably mounted a plurality of equally spaced idler pulleys 27 on approximately two inch axis spacing there-between.

The bottom frame assembly 21 also includes a U-shaped frame member 29 having a top wall 30 and a bottom wall 31 between which a plurality of idler pulleys 33 are rotatably mounted, which are identical to idler pulleys 27, and spaced apart the same distance except staggered with respect to idler pulleys 27.

A single flexible nylon cable 35 is wound around the pulleys 27 and 33 defining a plurality of parallel spaced rows approximately 1 inch apart.

A plurality of spheroidal silicon rubber members 37 are molded directly on the cable 35, and they form the body massaging elements according to the present invention. The spheroidal members 37 have an elliptical longitudinal section with a major diameter length of approximately 1.00 inches and a minor diameter length of approximately 0.80 inches and have a durometer in the range of 30 to 60 Shore A depending upon the desired body massaging effect. For increased body massaging effectiveness, a higher durometer is selected and for more user comfort a lower durometer is needed.

The silicon rubber members 37 are spaced 1/2 inch apart on the cable 35, and the parallel cable portions are maintained in parallel configuration to prevent tangling by elastic ties 40 extending transversely in zig-zag fashion entirely across the cushion section 23 and tied to each of the parallel cable portions 42, 43, etc. There are a plurality of rows of the elastic ties 40 throughout the length of the cushion section 23.

As seen more clearly in FIG. 2, the cushion section includes a flexible fabric cover 44 attached to the upper frame wall 26 by fasteners 45, and it wraps around the lower frame member 29 across the lower surfaces of rubber members 37 and is connected to the lower wall 24 of upper frame 18 by the same fasteners 45.

The ends 48 and 49 of the cable 35 are reciprocated by a linearly reciprocating tension assembly 52 having tensioning devices 53 and 54 at either end thereof.

The reciprocating tension assembly 52 includes a main threaded rod 57 supported in a worm gear 58 rotatably mounted in and axially fixed with respect to gear box support plates 60 and 61. The worm gear 58 has internal threads engaging rod 57 so that upon rotation worm gear 58, rod 57 moves axially in the gear box 19.

Rotation of the rod 57 is prevented by cross pins 63 and 64 that ride in teflon lined transverse grooves 67 in fixed sleeves 68 connected at their inner ends to the support plates 60 and 61 respectively.

The tension assemblies 53 and 54 each include a sleeve 70 threaded on the end of rod 57 and lock thereto by a lock nut 71. Sleeve 70 has an internal bore 73 into which the ends 48 and 49 of the cable extend and are biased inwardly with respect to the sleeves by coil compression springs 74 that react against a reciprocal bushing 75 carried by the ends of cable 35. Cable tension is adjusted by releasing lock nut 71 and rotating sleeve 72 until the desired tension is achieved.

In addition to providing tensioning for the cable 35, tension assemblies 53 and 54 act as shock absorbers as the rod 57 accelerates and decelerates during reciprocation thereby providing a smooth acceleration for the cable 35 after reversal.

The worm gear 58 is oscillated by a worm wheel 77 rotatably mounted in upper and lower gear box frame plates 79 and 80 illustrated more clearly in FIG. 3. Worm wheel 77 is rotated either by a hand wheel 80 or by motor 15 through flexible cable 17 and bevel gears 83 and 84.

It should be understood that motor 15 is a reversing motor in that it rotates in opposite directions cyclically and the angular rotation of its output shaft after reversal is adjustable and in this way the extent of the reciprocation of the rubber members 37 may be adjusted within certain limits. Preferably, such angular rotation of the output shaft motor 15 is selected to provide approximately ½ inch of travel of the rubber members 37. Moreover, the period or time of oscillation of the output shaft of motor 15 is adjustable to provide adjustable frequency of reciprocation for the rubber members 37, but as noted above, such period is on the order of 60 cycles per minute.

An alternative embodiment of the present invention is illustrated in FIGS. 4 and 5, wherein a right angular cushion assembly 110 is illustrated, and it should be understood that only a fragmented portion of the cushion is shown with the understanding that the cushion provides support and body stimulation in two transverse directions, such as would be found in an upright chair construction. Toward these ends, the stimulator 110 includes a vertical frame assembly 112 and a horizontal frame assembly 113. Frame assemblies 112 and 113 have pulleys 115 and 116 respectively that correspond to the pulleys 27 at the forward frame in the FIGS. 1 to 3 embodiment, and it should be understood that there are two additional frames at the opposite ends of frames 112 and 113 similar to the lower frame assembly 21 as shown in connection with the FIGS. 1 to 3 embodiment.

An important feature in the right angle cushion of FIGS. 4 and 5 is a right angle drive assembly 118 that permits drive cable 120 to drive both horizontal cushion rubber members 122 and vertical cushion rubber members 123.

This right angle drive assembly includes a first pulley 125 mounted on vertical frame 112 lying substantially in the plane of that frame and a second pulley 127 mounted adjacent to pulley 125 in the horizontal frame 113 and mounted for rotation generally in the plane of the horizontal cushion. A small pulley 130 is rotatably mounted in a frame 131 connected to horizontal frame assembly 113 with its axis lying on the pivotal axis of the vertical frame 112 with respect to the horizontal frame 113, if such pivotal movement be desired. Pulley 130 carries cable 120 and directs it 90 degrees from a vertical direction to a horizontal direction so that it may wrap around pulleys 116 to drive rubber members 122 associated with the horizontal cushion.

I claim:

1. A generally planar body stimulating device, comprising: a pair of spaced flexible planar housing covers, a plurality of parallel rows of generally spheroidal flexible body stimulating members mounted for reciprocation between the flexible housing covers, a pulley at each end of each row of spheroidal members mounted in frame members which surround the flexible housing covers, said pulleys being mounted for rotation about an axis perpendicular to the plane of the housing covers, a single cable supporting and interconnecting the spheroidal members and passing over the pulleys, means to impart a reciprocable movement to said cable to reciprocate the spheroidal members in a plane parallel to the plane of the housing covers with the spheroidal members of adjacent rows always being moved in opposite directions, said cable having first and second ends, said means to import a reciprocable movement including a reciprocating rod having ends connected to the cable for alternately pulling the first and second ends of the cable, and shock absorbing means between the rod and the first and second ends of the cable.

2. A generally planar body stimulating device as defined in claim 1, wherein the shock absorbing means includes a coil compression spring at each end of the rod connecting the first and second ends of the cable to the rod.

3. A generally planar body stimulating device, comprising: a generally rectangular stationary frame with a flexible cover thereon, a plurality of parallel rows of non-rotatable general spheroidal flexible body stimulating members mounted for support in the frame generally in the plane thereof and slidably engageable with the cover, single cable means having ends, carrying the body stimulating members in parallel spaced rows for reciprocation in the direction of the rows, means supporting the cable so that adjacent rows reciprocate simultaneously in opposite directions, and drive means for alternately pulling on opposite ends of the cable.

4. A generally planar body stimulator as defined in claim 3, wherien the spheroidal members are rubber having a durometer in the range of Shore A 30 to 60 durometer.

5. A generally planar body stimulator as defined in claim 3, including motor means to reciprocate the cable.

6. A generally planar body stimulator as defined in claim 3, wherein said spheroidal members are molded directly on the cable.

7. A generally planar body stimulator as defined in claim 3, including a worm and interengaging worm gear for reciprocating the spheroidal members.

8. A generally planar body stimulator as defined in claim 3, including a plurality of pulleys for reversing the direction of the cable.

9. A generally planar body stimulator as defined in claim 3, wherein the means for pulling on the cable includes motor means to reciprocate the cable, and shock absorber means between the motor and the cable to smoothly accelerate and decelerate the cable as the motor means reverses the cable direction.

* * * * *